US007389763B2

(12) United States Patent
Kochi et al.

(10) Patent No.: US 7,389,763 B2
(45) Date of Patent: Jun. 24, 2008

(54) CYLINDER BLOCK INTEGRATED WITH CRANKCASE

(75) Inventors: Hiroyoshi Kochi, Kanagawa-ken (JP); Manabu Sekimukai, Kanagawa-ken (JP); Yosuke Maruta, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/550,501

(22) Filed: Oct. 18, 2006

(65) Prior Publication Data

US 2007/0144479 A1 Jun. 28, 2007

(30) Foreign Application Priority Data

Oct. 19, 2005 (JP) ..... 2005-303977

(51) Int. Cl.
*F02F 1/00* (2006.01)
*F02F 7/00* (2006.01)

(52) U.S. Cl. ..... 123/200; 123/193.2; 123/195 H

(58) Field of Classification Search ..... 123/195 C, 123/195 H, 193.2, 195 R, 195 HC, 195 AC
See application file for complete search history.

(56) References Cited

U.S. PATENT DOCUMENTS 6,536,398 B2 * 3/2003 Neal ..... 123/195 C
6,990,943 B2 * 1/2006 Koyama ..... 123/193.2
7,255,085 B2 * 8/2007 Shin ..... 123/195 C

FOREIGN PATENT DOCUMENTS

JP 3243555 B2 10/1991
JP 3087106 B2 7/2000

* cited by examiner

*Primary Examiner*—Stephen K. Cronin
*Assistant Examiner*—Hyder Ali
(74) *Attorney, Agent, or Firm*—Kanesaka, Berner & Partners LLP

(57) ABSTRACT

A structure of crankcase-integrated cylinder block for a small internal combustion engine is posed to increase strength and rigidity in order to reduce particularly vibration and noise. A cylinder part and a crankcase part are formed into a box-like shape being cast in one piece, a crankcase cover is fixed to the crankcase part to cover an opening on a side in anteroposterior thereof, a crankshaft bearing boss has a crankshaft bearing hole being provided at a central part of a back wall of the crankcase part to protrude to both inner and outer sides of the back wall for supporting an end sides of a crankshaft, wherein an inner peripheral rib is formed along the corner where the back wall of said crankcase part connects to a peripheral wall extending from the periphery of the back wall to heave inward form the corner part.

9 Claims, 7 Drawing Sheets

CYLINDER BLOCK INTEGRATED WITH CRANKCASE

RELATED APPLICATIONS

The present application is based on, and claims priority from, Japanese Application No. 2005-30977, filed Oct. 19, 2005, the disclosure of which is hereby incorporated by reference herein in its entirety.

BACKGROUND OF THE INVENTION

1. Field of the Invention

The present invention relates to a cylinder block integrated with a crankcase, which is a single cast block integrating a cylinder part and a crankcase part, particularly a crankcase-integrated cylinder block of a small internal combustion engine reinforced in strength and rigidity for reducing vibration and noise.

2. Description of the Related Art

As is well known, the main body of a small single cylinder internal combustion engine consists of a cylinder part in which a piston reciprocated and a crankcase part in which a crankshaft is supported for rotation. A cylinder head is attached to the top end of the cylinder part and a crankcase cover is attached to the crankcase part at an opening in one side of thereof to cover the opening. In small internal combustion engines, the cylinder part and crankcase part are cast in one unit block. Such a unit block is called a crankcase-integrated cylinder block.

In such a crankcase-integrated cylinder block (hereafter referred to as a cylinder block), endeavors have been continued to reduce thickness of walls of the cylinder block from the point of view of downsizing and weight saving of the internal combustion engine. However, there occur often problems when thickness of walls of the cylinder block is reduced that the strength/rigidity thereof reduces, vibration is increased, resulting in occurrence of cracks and increase in noise.

When designing a cylinder block, a fundamental plan is established through studying strength and vibration characteristic by calculation, however, the structure of the cylinder block is very complicated three-dimensionally and difficult to analyze. Designing labor has been reduced by calculating using a computer by applying a finite-element method, however, the calculation enables evaluation of a cylinder block of specific shape only, and it is necessary to compare calculation results of a variety of constructions of cylinder blocks in order to carry out optimization of cylinder block configuration. Therefore, designing of a cylinder block remains yet in a state that a vast amount of labors is needed for calculation, and here remain problems concerning designing cost and design schedule.

To solve the problems, there is disclosed in Japanese Patent No.3087106 an art to provide a crankcase-integrated cylinder block with reduced wall thickness resulting in decreased weight of engine, without entailing reduction in strength and increase in noise, and enabling reduction of design cost for optimizing the configuration of cylinder block.

According to the prior art like this, the cylinder block is constructed such that large force bearing portions such as a base part (fixing foot part) for installing the engine and bearing parts for supporting the crankshaft are thick, and forces exerting to such thick portions are transmitted from the thick portions to thin walls in a state distributed to ribs, etc. To be more specific, as shown in FIG. 5(B) in the patent specification, a first bearing boss having a first bearing hole for inserting a first bearing is provided on the central part of the crankcase cover to protrude inwardly, a second bearing boss having a second bearing hole for inserting a second bearing is provided on the central part of the backside wall of the cylinder block to protrude inwardly, a pair of upper side boss-ribs is provided to extend from the upper part of each of the bearing bosses widening the distance between each of the boss-ribs upwardly, and a pair of lower side boss-ribs is provided to extend from the lower part of each of the bearing bosses widening the distance between each of the boss-ribs downwardly.

However, in the art, the trapezoidal region surrounded by the upper side boss-ribs of the first bearing boss, upper rib of the crank case cover, and a part of the outer periphery of the first bearing boss, and the trapezoidal region surrounded by the upper side boss-ribs of the second bearing boss, upper rib of the cylinder block, and a part of the outer periphery of the second bearing boss, must be formed to be thick. Therefore, portions where large force is supported such as a base part (fixing foot part) to install the engine and bearing parts for supporting the crankshaft are formed thick, and thin-walled cylinder block configuration is not attained fully enough.

Further, application of the prior art is restricted to a crankcase-integrated having a vertical cylinder and can not be applied to a crankcase-integrated cylinder block having an inclined cylinder.

It is difficult to apply said prior art to an inclined cylinder type engine such as disclosed for example in Japanese Patent No.3243555 in which a crankcase-integrated cylinder block which has a cylinder part extending from an inclined wall part of the crankcase part perpendicular thereto and of which the cylinder axis is inclined from the direction perpendicular to the base part for installing the engine.

SUMMARY OF THE INVENTION

The present invention was made through studying and discerning reasons of occurrence of noise and vibration based on results obtained from experiments and FEM (finite-element method) analysis, and the object of the invention is to provide a construction of a crankcase-integrated cylinder block which is increased in strength/rigidity by adding and strengthening ribs while maintaining thickness of thin parts of the cylinder block in particular and reduced in vibration and noise, while following the conventional fundamental construction of crankcase-integrated cylinder blocks.

The invention aims particularly to provide a construction with which weight saving more than the prior art is attainable and which is applicable easily also to an engine having a cylinder block with a cylinder body protruding slantingly from an end part of a crankcase.

To attain the object, the present invention proposed a cylinder block integrated with a crankcase used for a single-cylinder small internal combustion engine, a cylinder part and a crankcase part formed into a box-like shape being cast in one piece, a crankcase cover being fixed to the box-like shaped crankcase part, a crankshaft bearing boss having a crankshaft bearing hole being provided at a central part of a back wall of the crankcase part to protrude to both inner and outer sides of the back wall for supporting an end sides of a crankshaft, wherein an inner peripheral rib is formed along the line of intersection of the back wall which is thin in thickness of the crankcase part with a peripheral wall which is thin in thickness and extending from the periphery of the back wall to form the box-like shaped crankcase part at least along a part of the line of intersection positioned opposite to the cylinder parts, the inner peripheral rib heaving inward from the peripheral wall, in other words, a crankcase-integrated cylinder block integrated with a crankcase which has an inner peripheral rib formed along the corner where the thin back wall of the crankcase part connects to a peripheral wall extending from the periphery of the back wall to heave inward from the corner part. Concretively, as shown in FIG. 2, truss structures of near triangular shape are composed around the crankshaft bearing boss with the crankshaft boss 19, a plurality of the ribs 22 extending radially from the crank bearing boss 19, and the inner peripheral rib 40 at least on a region of the back wall positioned opposite to the joining part of the cylinder part to the crankcase part, i.e. on a region where the left wall, bottom wall, and ceiling wall connect to the back wall.

It is of course preferable to provide the inner peripheral rib all along the corner where the back wall connects to the peripheral wall.

When applied to a single cylinder small internal combustion engine of inclined cylinder type, the crankcase-integrated cylinder block which has the peripheral wall consisting of the bottom wall, left wall, ceiling wall, upper right wall where the cylinder part connects, and lower right wall connecting to the bottom wall can be increased in load bearing balance by providing the inner peripheral rib at least to the corner part where the bottom wall, left wall, and ceiling wall connect to the back wall to heave inward from these three wall parts.

It is preferable that the width of the inner peripheral rib in the direction parallel to the peripheral wall is larger than the sum of height of the rib from the peripheral wall and thickness of the peripheral wall, concletively that the width of the inner peripheral rib is about three times the thickness of the peripheral wall and the sum of height of the rib from the peripheral wall and thickness of the peripheral wall is about two times the thickness of the peripheral wall.

Further, it is preferable that a rib extending obliquely downward and two ribs 42 extending obliquely upward along a line parallel to the cylinder center axis are provided to the back wall on its outer face, and a rib extending obliquely downward and two ribs extending obliquely upward along a line parallel to the cylinder center axis are provided to the crankcase cone on its inner face.

Furthermore, it is preferable that a rib is provided between a base part provided in the lower part of the crankcase part to extend horizontally and each of the left and lower right walls at about the center of depth of each of the walls, a horizontal rib is provided on the left wall on its outer face, and two vertical ribs are provided on the left wall on its outer face to extend vertically from the upper surface of the horizontal rib parallel to each other, of which one nearer to the back wall being extended to the ceiling wall where there are provided two ribs extending perpendicular to the vertical rib nearer to the back wall to connect to the vertical rib.

According to the present invention, the inner peripheral rib reinforces the intersection part of the thin peripheral wall and back wall of the crankcase part by thickening along the intersection part in order to be able to bear force along the intersection part, and truss structures are composed with the inner peripheral rib and other ribs, so the strength of the crankcase part is increased and deformation of the crankcase part, to be more specific, change of the angle between the intersecting walls due to load of the engine, with the result that the crankcase part is increased in rigidity and vibration and noise and be reduced.

Further, the ribs provided on the outer face of the back wall of the crankcase part and on the inner face of the crankcase cover, one extending from each of the crankshaft bearing boss obliquely downward and two extending obliquely upward, works effectively to reinforce against the force of explosion in the combustion chamber exerting in the direction of cylinder axis to the bearing bosses.

Further, the two wide ribs provided between on the left wall of the crankcase part serve mainly to increase rigidity of the side wall resulting in suppression of vibration and noise, and the wide ribs, and ribs provided between the upper faces of both the left and right of the base part and the left and right side wall respectively works mainly to increase strength of the base part against bending.

Effects of these means to increase strength and rigidity were verified through endurance tests, and vibration and noise were suppressed by the increase in rigidity.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

A preferred embodiment of the present invention will now be detailed with reference to FIGS. 1-7.

Figure 1:
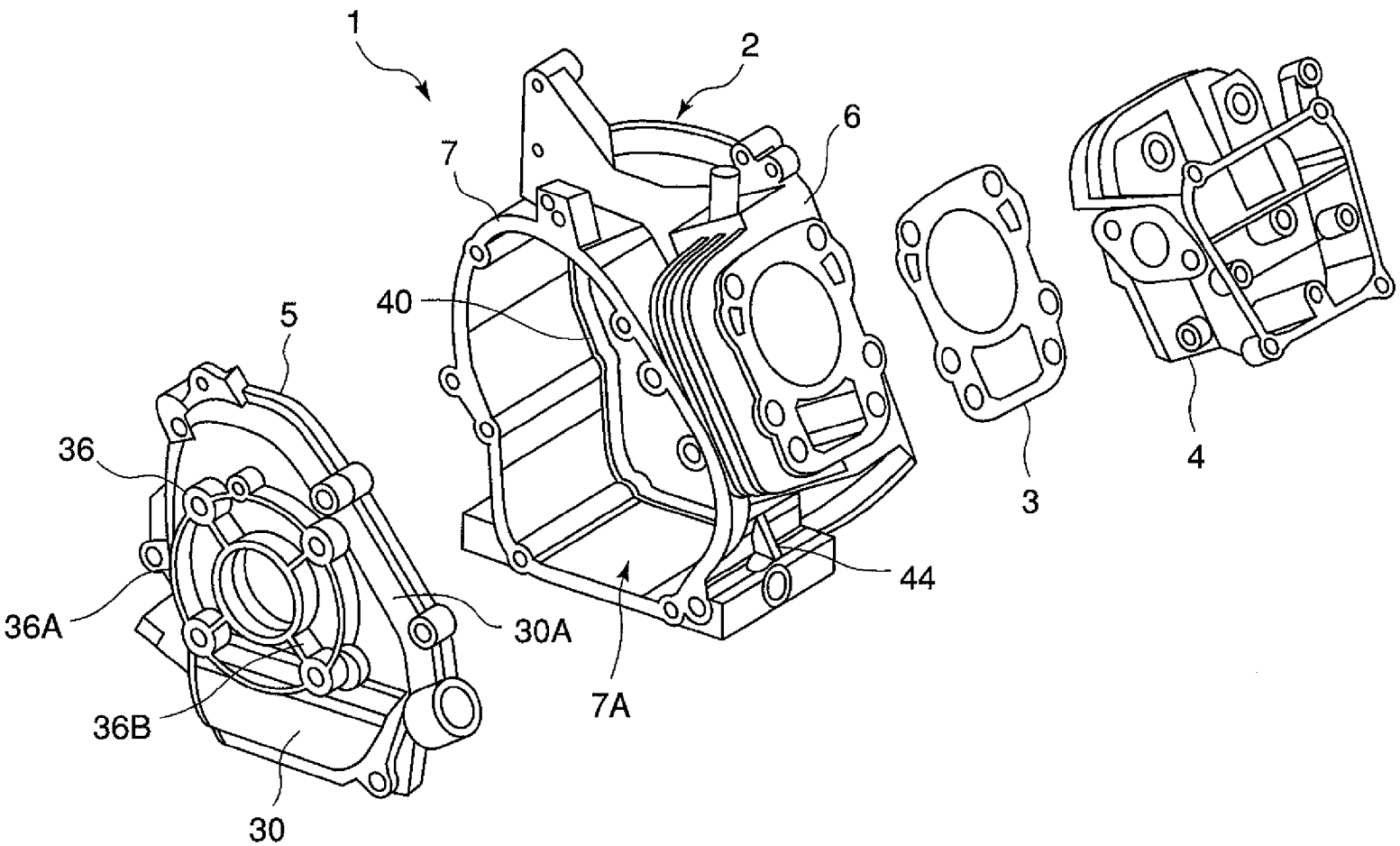
FIG. 1 is an exploded perspective view of the main body of the engine to which the present invention is applied, viewed from upper left of the output shaft side.
Figure 2:
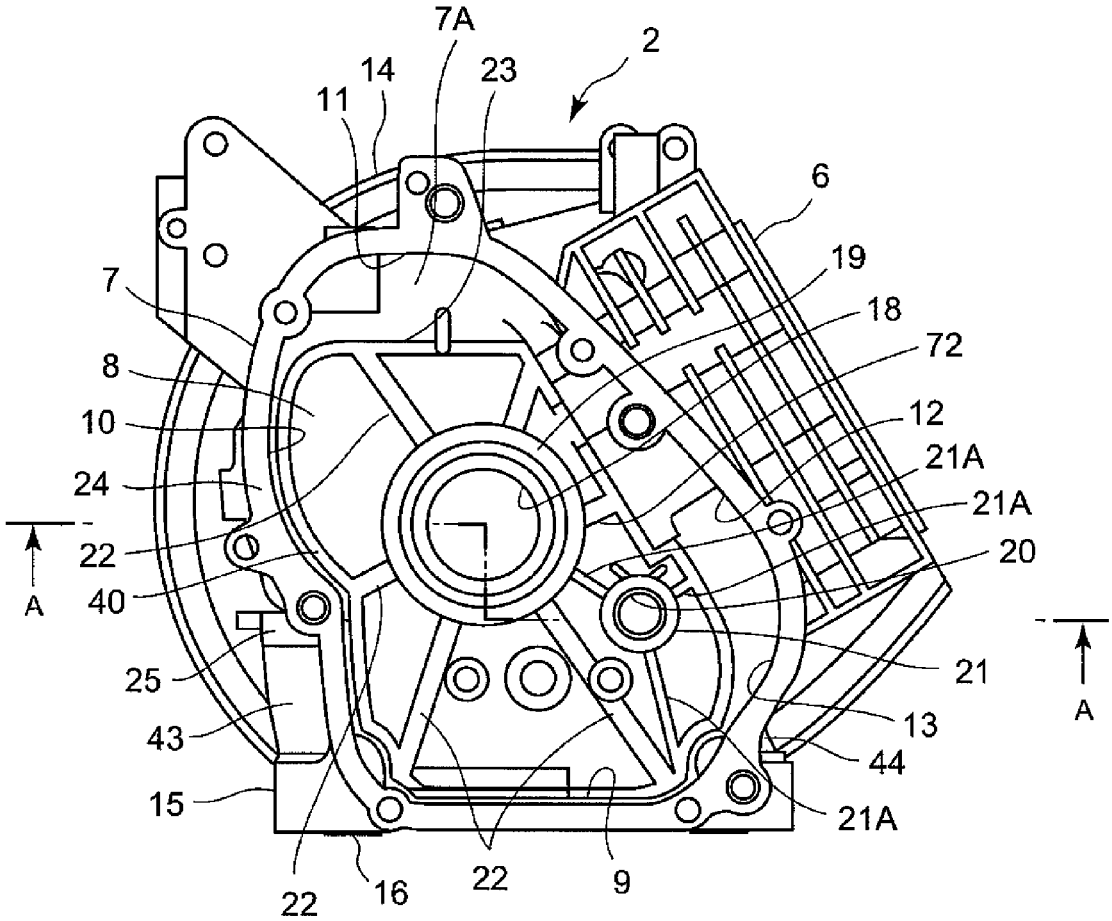
FIG. 2 is a front elevation of the cylinder block of the present invention viewed from the output shaft side (crankcase cover side).
Figure 3:
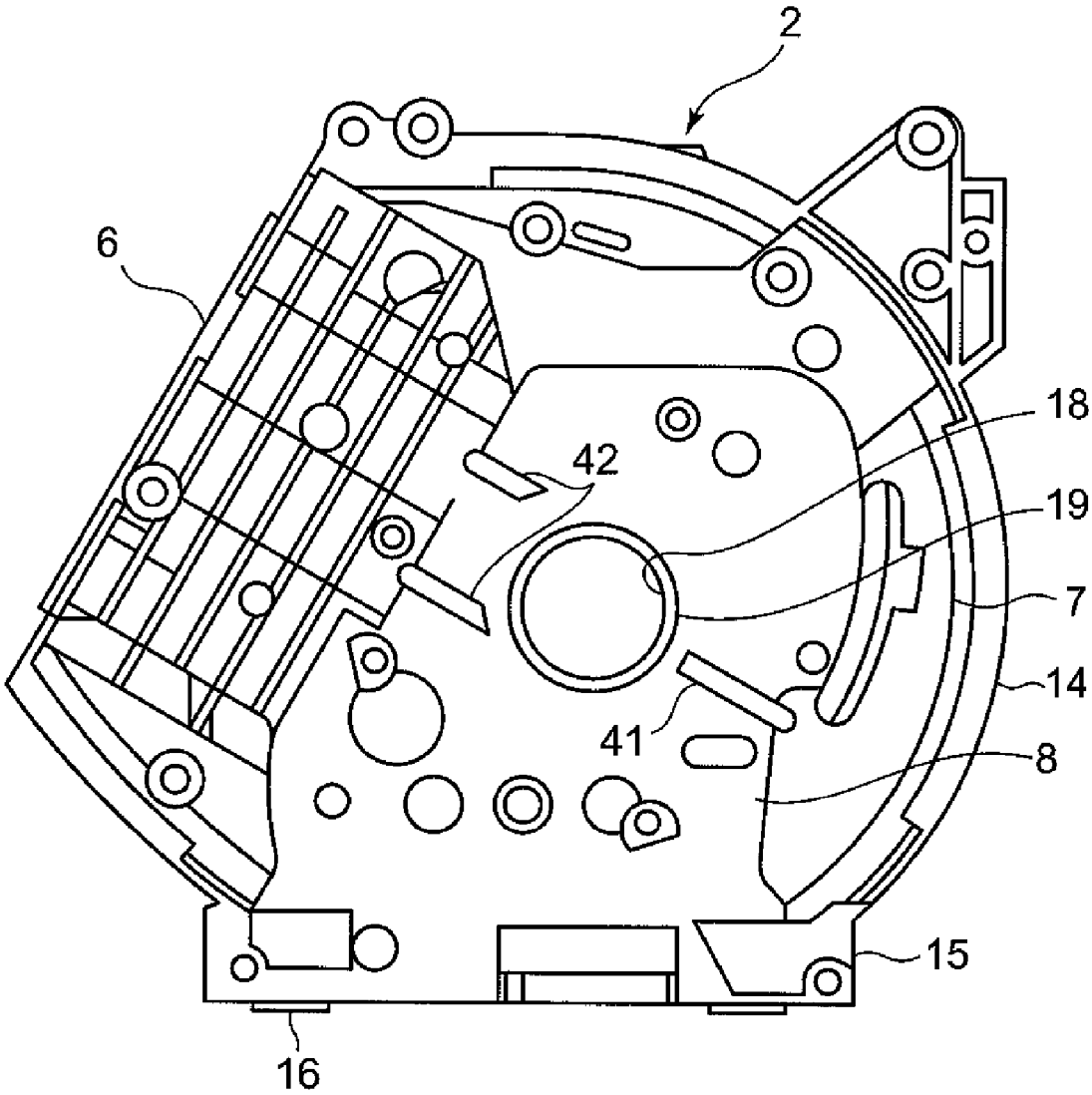
FIG. 3 is a rear elevation of the cylinder block of FIG. 2.

FIG. 1 is an exploded perspective view of the main body of the four-cycle inclined-cylinder internal combustion engine to which the present invention is applied, viewed from upper left of the output shaft side. The engine main body 1 is comprised of a crankcase-integrated cylinder block (hereafter referred to as cylinder block) 2, a cylinder head 4 fastened by means of bolts to the top end face of the cylinder block 2 via a gasket 3, and a crankcase cover 5 fastened by means of bolts to a side face of the cylinder block 2 via a gasket or liquid sealer (liquid packing). FIG. 2 is a front elevation of the cylinder block viewed from the output shaft side (crankcase cover side), and FIGS. 3, 4, 5, and 6 is respectively a rear view, plan view, left side view, and section taken along lines A-A of FIG. 2.

The present invention relates to the construction of the cylinder block 2 including the crankcase cover 5.

The cylinder block 2 (see mainly FIGS. 1 and 2) has a cylinder part 6 having a number of cooling fins on its periphery and a cylinder liner not shown in the drawings in its inner side, and a box-like crankcase part 7 for accommodating a crankshaft and supporting an end side (output side) thereof for rotation.

Both of the parts 6, 7 are cast in one piece to form a crankcase-integrated cylinder block 2.

The cylinder part 6 is inclined from vertical direction toward horizontal direction for decreasing the total height of the engine, thus the cylinder block is of a construction with inclined cylinder with the cylinder axis not coinciding with the vertical axis and horizontal axis of the engine. Bolt-holes are provided the around the opening provided at the top end face of the cylinder part 6 and around the opening provided at the front face 7A of the box-like crankcase part 7 so that the openings are covered respectively with the cylinder head 4 and crankcase cover 5 by fixing them by means of bolts not shown in the drawings as mentioned above.

The crankcase part 7 is a thin-walled box-like structure with its front side opened, a peripheral wall, which consists of bottom wall 9, left wall 10, ceiling wall 11, upper right wall 12 slanting linearly downward, and lower right wall 13 continuing to the bottom wall 9, protruding from the periphery of the back wall 8 at the opposite side to the opening 7A in the direction perpendicular to the back wall 8. The ceiling wall 11 and lower right wall 13 are formed into two-stepped wall in the direction of the crank shaft (hereafter referred to as anteroposterior direction) with the opening side widened.

The cylinder part 6 connects to the slanting upper right wall 12. A disk-like plate part 14 for attaching a fan case is provided near the back wall 8 to extend parallel to the back wall 8.

At the lower part of the crankcase part 7 is provided a base part (fixing foot part) 15 extending horizontally in the left and right directions for fixing the engine. The base part 15 is a box-like structure formed integral with the bottom wall 9, surrounded with plate part in a rectangular shape, its downside being open, having bosses 16 for providing bolt holes to insert engine installation bolts at four corners of the rectangular shape, the bosses being connected with strengthening ribs. Oil drain openings 17 (see FIG. 5) are provided at the left and right sides at the center parts in anteroposterior direction thereof.

A crankshaft bearing boss 19 (see FIG. 6) for providing a crankshaft bearing hole 18 to insert a crankshaft bearing is provided at about the center of the back wall 8, and at the lower left position from the boss 19 in FIG. 2 is provided a camshaft bearing boss 21 for providing a camshaft bearing hole 21. The bosses are provided to protrude in both inner and outer sides of the back wall 8. An end side of the crankshaft is rotatably supported by the bearing fitted into the bearing hole 18, and an end side of the camshaft is rotatably supported by the bearing hole 18.

The crankshaft bearing boss 19 and camshaft bearing boss 21 are provided with a plurality of ribs 22, 21A (six ribs 22 extending radially from the crankshaft bearing boss 19 and three ribs 21A extending radially from the camshaft bearing boss 21 and a rib 23 extending in anteroposterior direction at the position near to the back wall 11 for distributing each load exerting on each of the bosses to the back wall 8. The periphery of the opening 7A of the crankcase part 7 is formed into a thick flange 24 crooked outward to form a flat face for attaching the crankcase cover 5 via liquid sealer, a plurality of screw holes being provided to the flange 24 for fixing the crankcase cover, and the flange 24 serves as a strengthening member of the periphery part of the crankcase part 7.

The crankcase cover 5 (see FIGS. 1 and 7) is a cover to cover the opening 7A of the crankcase part 7. It is formed into a thin-walled shallow box-like shape, and a crankshaft bearing boss 32 is provided on the rear face (inside face facing the inner space of the crankcase part) of the main wall 30, which faces the back wall 8 of the crankcase part 7, at the central part thereof for providing a crankshaft bearing hole 31 to fit a crankcase bearing for rotatably supporting the other end side of the crankshaft. At the lower left of the boss 32 is provided a camshaft boss 33 is provided to protrude both the inner side and outer side of the main wall 30. The end part of the side wall of narrow width surrounding the main wall 30 is formed into a flange 34 to correspond to the flange 24 of the crankcase part 7, a plurality of bolt holes being provided to the flange 34.

A plurality of ribs 35 (six ribs extending radially from the crankshaft bearing boss 32) and a plurality of ribs 33A (three ribs extending from the camshaft bearing boss 33) are provided on the rear face of the main wall 30. On the front side of the main wall 30 (see FIG. 1) are provided a plurality of bosses 36 protruding from the front face for providing screw holes to install a work machine. Circular arc ribs 36A connecting these bosses 36 and radially extending ribs 36B connecting the bearing boss 32 to the bosses 36 are provided. Reference numerals 37 are oil supply holes provided on both side of the side wall at lower parts.

A rib 40 of near rectangular (trapezoidal) cross section is formed in the inner side of the crankcase part 7 along the line of intersection of the back wall 8 of the crankcase part 7 with the peripheral wall consisting of the bottom wall 9, left wall 10, ceiling wall 11, upper right wall 12, and lower right wall 13, each protruding from the back wall 8 perpendicularly thereto, so that thickness a of the peripheral wall including the rib 40 is about twice the original wall thickness and width b is about three times the original wall thickness (see FIGS. 2 and 6) to increase strength and rigidity (hereafter the rib 40 is referred to as inner peripheral rib). A plurality of the ribs 22 extending radially from the crank bearing boss 19 are connected to the inner peripheral rib 40 so that the crankshaft bearing boss 19, ribs 22 extending radially, and rib 40 form truss structure of near triangular shape around the crankshaft bearing boss.

Further, on the outer face of the back wall 8 of the crankcase part 7 are provided a rib 41 extending obliquely downward and two ribs 42 extending obliquely upward along a line parallel to the cylinder center axis and passing the center of the crankshaft bearing boss 19. A rib 43 and rib 44 are provided between the base part 15 and the left wall 10, and between the base part 15 and the lower right wall 13 respectively at a central part in anteroposterior direction, mainly for strengthening purpose (see FIGS. 1 and 2). The rib 43 on the left wall side is of quadrangular shape, of which a longitudinal side connects to the left wall 10, the lower end connects to the upper surface of the base part 15, and the upper end connects to the undersurface of a rib 25 which is a part for attaching auxiliary equipment and extending in anteroposterior direction. The rib 44 on the right wall side 13 is of triangular shape, of which two sides connect to the upper surface of the base part 15 and the lower right wall 13.

Figure 4:
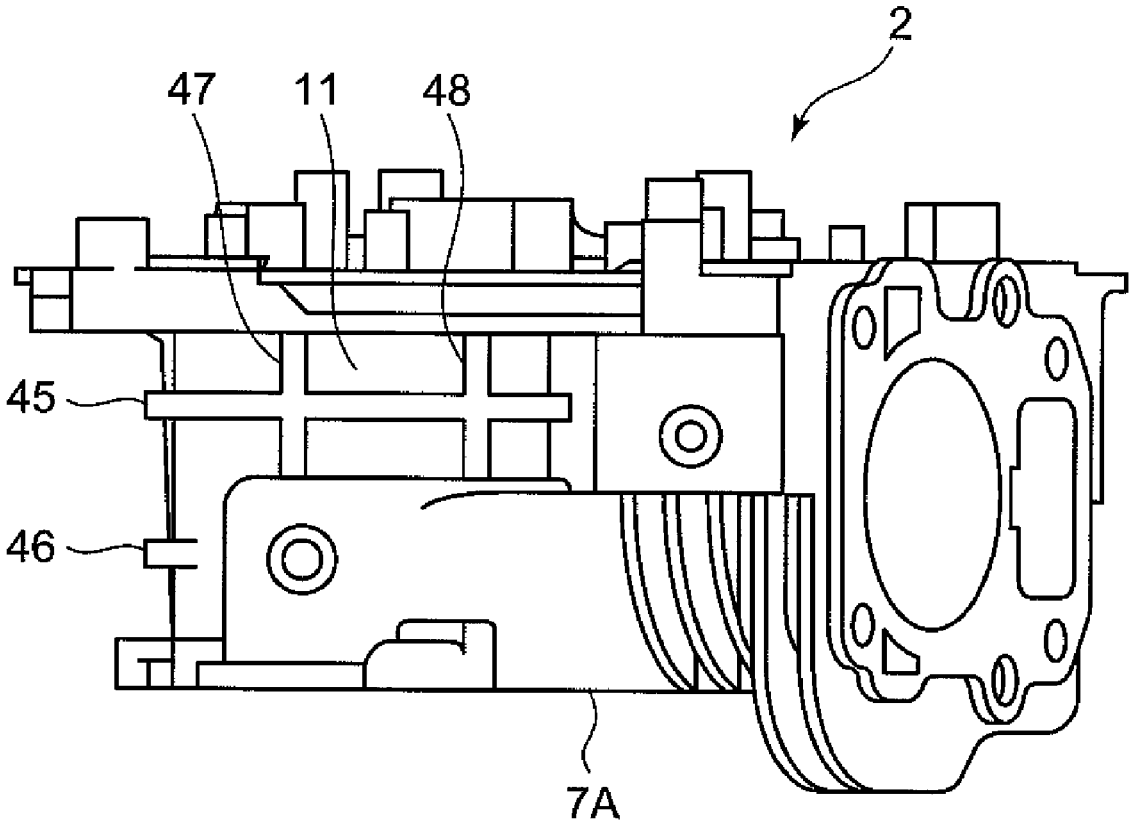
FIG. 4 is a plan view of the cylinder block of FIG. 2.
Figure 5:
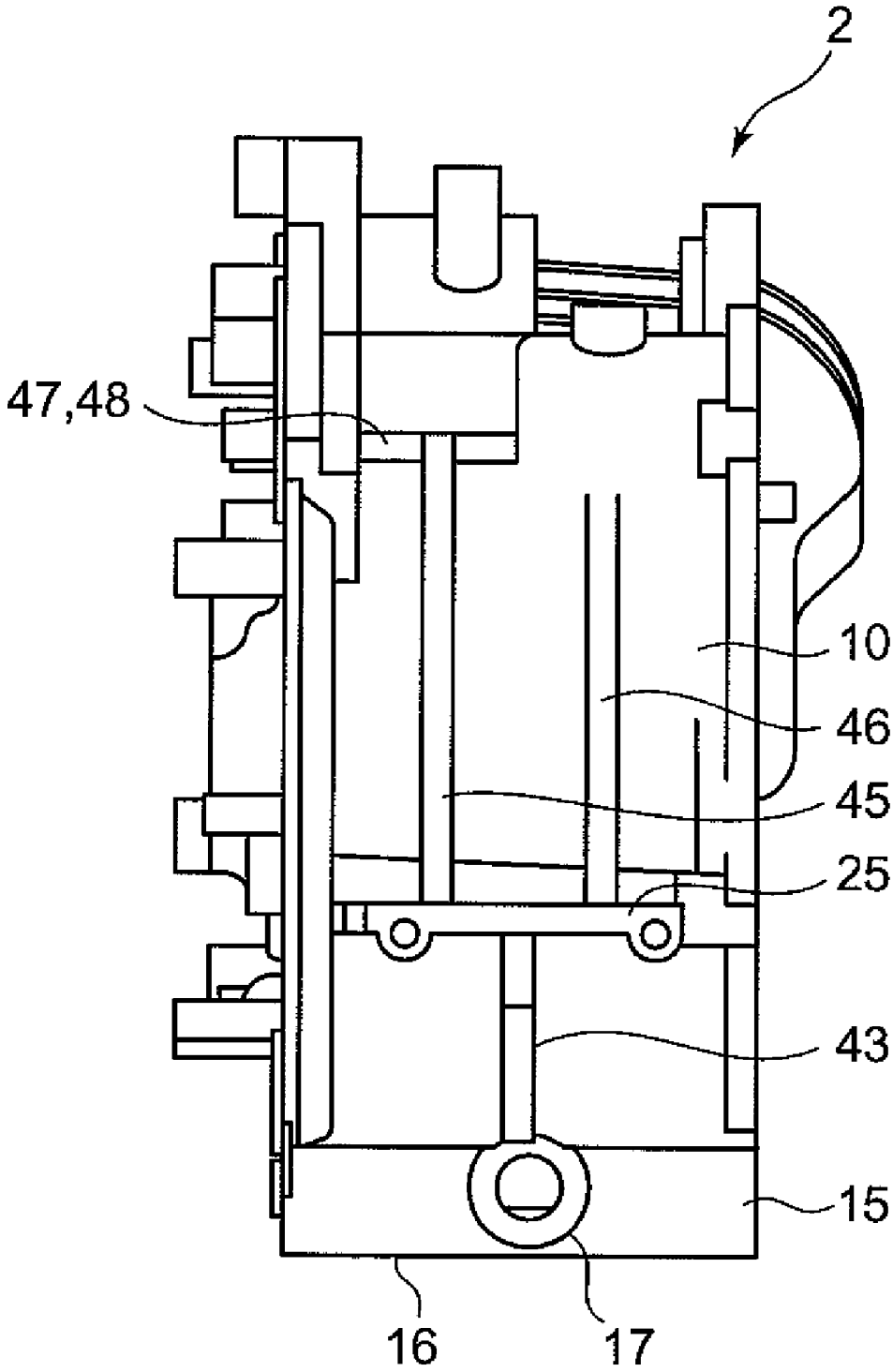
FIG. 5 is a left side view of the cylinder block of FIG. 2.
Figure 6:
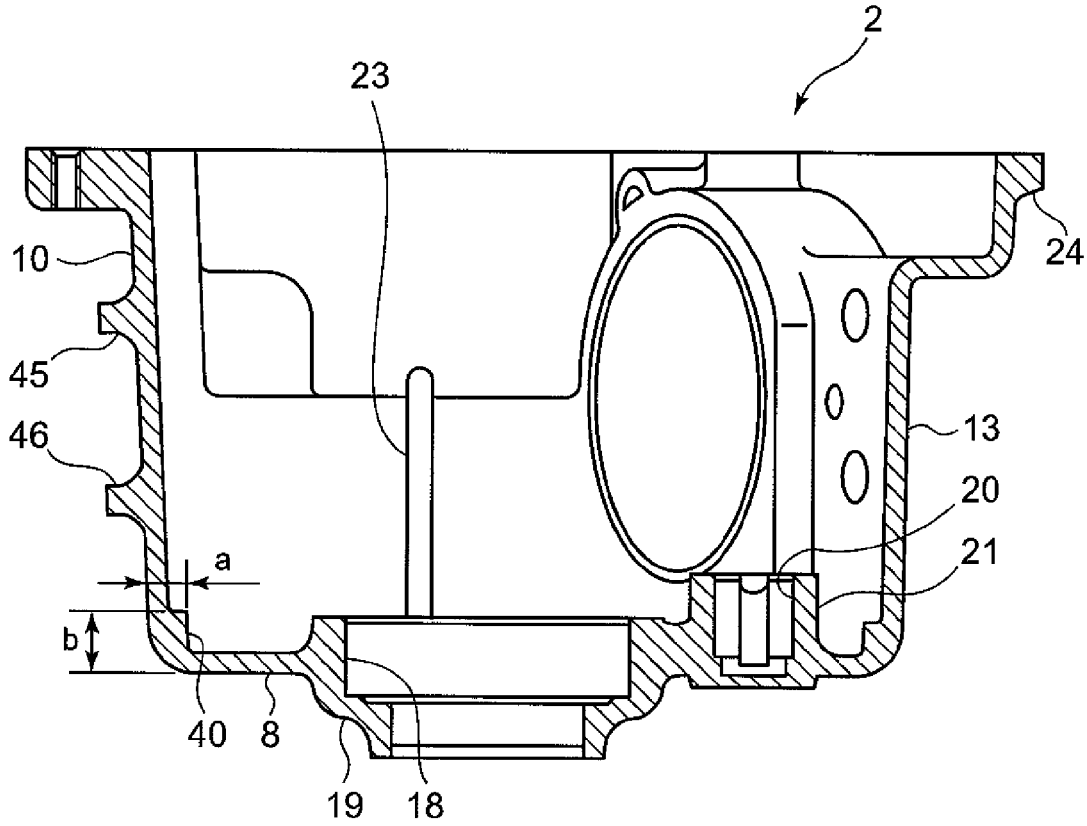
FIG. 6 is a section taken along line A-A of FIG. 2.
Figure 7:
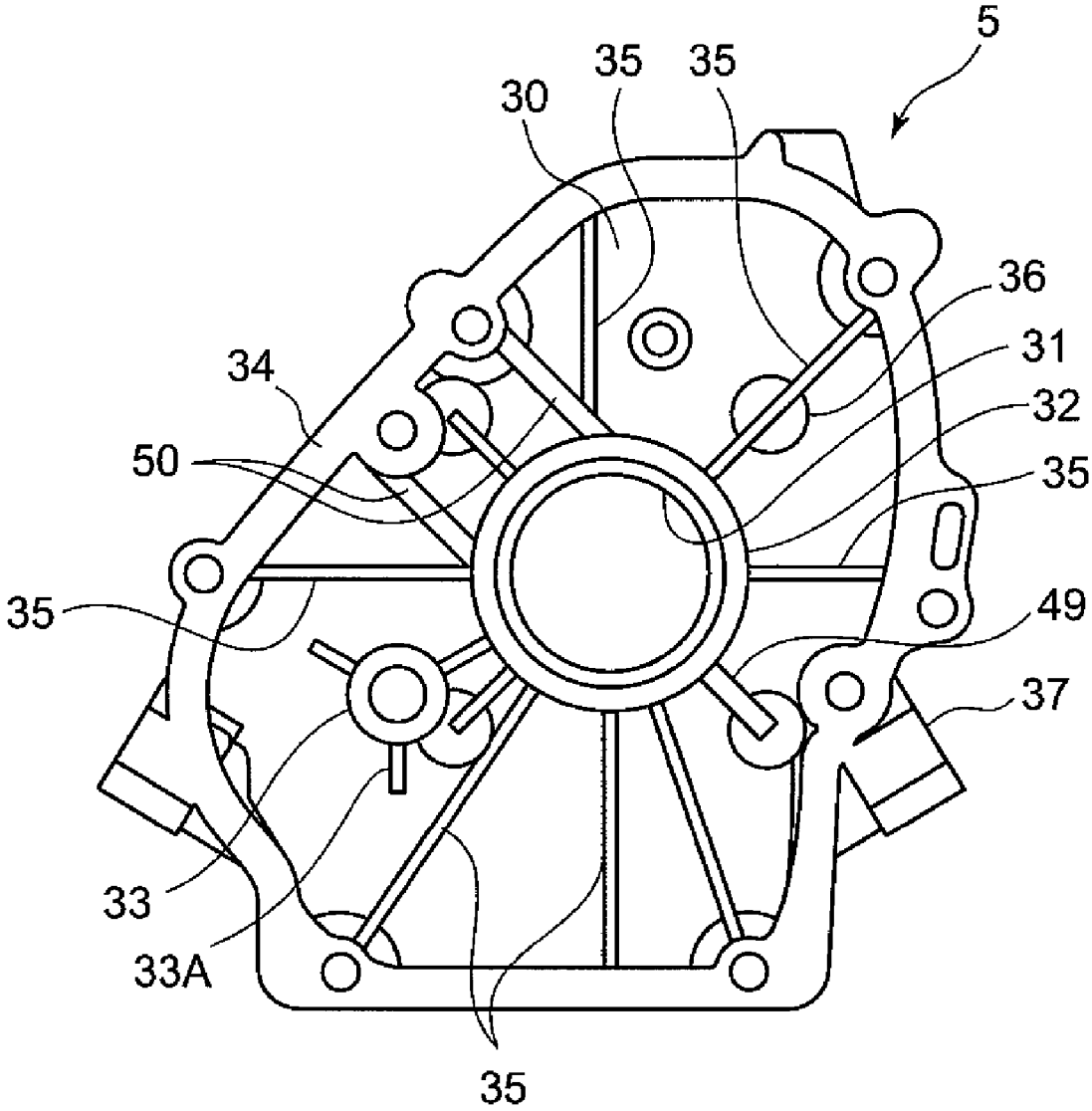
FIG. 7 is a rear elevation of the crankcase cover of the invention showing the inner side thereof.

Further, two wide ribs 45 and 46 for increasing rigidity are provided on the left wall 10 to extend upward from the upper surface of the rib 25 for attaching auxiliary equipment parallel to the end face of the flange 24 of the opening 7A, of which the rib 45 nearer to the back wall 8 extends to the ceiling wall 11, and the two reinforcement ribs 47, 48 are provided on the ceiling wall 11 to extend in anteroposterior direction intersecting perpendicularly with the rib 45 (see FIGS. 4, 5, and 6). On the rear face (inside face facing the inner space of the crankcase part) of the main wall 30 are provided a rib 49 extending obliquely downward and two ribs 50 extending obliquely upward along a line parallel to the cylinder center axis and passing the center of the crankshaft bearing boss 32 to correspond to the ribs 41 and 42 (see FIG. 3) provided on the outside face of the back wall 8.

Internal combustion engines equipped with crankcase-integrated cylinder block increased in strength and rigidity as described above was proved that vibration and noise are suppressed enough compared to conventional engines by various operation tests as mentioned before, that those effects were particularly conspicuous in no load operation, and that durability was increased sufficiently.

Although a case that the present invention is applied to inclined cylinder type internal combustion engines has been described in the foregoing, the invention can be applied to a case of upright cylinder type internal combustion engines in which the cylinder erects vertically from the crankcase.

What is claimed is:

1. A cylinder block integrated with a crankcase used for a single-cylinder small internal combustion engine, a cylinder part and a crankcase part formed into a box-like shape being cast in one piece, a crankcase cover being fixed to the crankcase part to cover an opening on a side in an anteroposterior direction thereof, a crankshaft bearing boss having a crankshaft bearing hole being provided near at a central part of a back wall of said crankcase part to protrude to both inner and outer sides of said back wall for supporting an end sides of a crankshaft, wherein an inner peripheral rib is formed along the corner where said back wall of said crankcase part connects to a peripheral wall extending from the periphery of said back wall and extends from the periphery of said back wall to form said box-like shaped crankcase part, and wherein said inner peripheral rib heaves inward from said corner part.

2. A cylinder block integrated with a crankcase used for a single-cylinder small internal combustion engine, comprising a cylinder part and a crankcase part formed into a box-like shape being cast in one piece, a crankcase cover being fixed to the box-like shaped crankcase part, a crankshaft bearing boss having a crankshaft bearing hole being provided near at a central part of a back wall of said crankcase part to protrude to both inner and outer sides of said back wall for supporting an end sides of a crankshaft, wherein an inner peripheral rib is formed along the line of intersection of said back wall which is thin in thickness of said crankcase part with a peripheral wall which is thin in thickness and extending from the periphery of said back wall to form said box-like shaped crankcase part at least along a part of said line of intersection positioned opposite to said cylinder parts, said inner peripheral rib heaving inward from said peripheral wall.

3. The cylinder block integrated with the crankcase according to claim 2, wherein truss structures of near triangular shape are formed with the crankshaft bearing boss, a plurality of the ribs extending radially from the crankshaft bearing boss, and the inner peripheral rib on the inner face of the back wall around the crankshaft bearing boss at least in a region opposite to the cylinder part.

4. The cylinder block integrated with the crankcase according to claim 2, wherein said inner peripheral rib is provided all along the inner peripheral part where said peripheral wall connects to the back wall.

5. The cylinder block integrated with the crankcase according to claim 2, wherein said peripheral wall is formed of a bottom wall, a left wall, a ceiling wall, upper left wall where said cylinder part connects, and a lower right wall connecting to said bottom wall, and an inner peripheral rib is provided to heave inwardly at least from said bottom, left, and ceiling walls.

6. The cylinder block integrated with the crankcase according to claim 2, wherein width of said inner peripheral rib in the direction parallel to said peripheral wall is larger than the sum of height of said rib from said peripheral wall and thickness of said peripheral wall.

7. The cylinder block integrated with the crankcase according to claim 6, wherein said width of said inner peripheral rib is about three times the thickness of said peripheral wall and the sum of height of said rib from said peripheral wall and thickness of said peripheral wall is about two times the thickness of said peripheral wall.

8. The cylinder block integrated with the crankcase according to claim 2, wherein a rib extending obliquely downward and two ribs extending obliquely upward along a line parallel to the cylinder center axis are provided to said back wall on its outer face, and a rib extending obliquely downward and two ribs extending obliquely upward along a line parallel to the cylinder center axis are provided to said crankcase cover on its inner face.

9. The cylinder block integrated with the crankcase according to claim 1, wherein a rib is provided between a base part provided in the lower part of said crankcase part to extend horizontally and each of said left and lower right walls at about the center of depth of each of said walls, a horizontal rib is provided on said left wall on its outer face, and two vertical ribs are provided on said left wall on its outer face to extend vertically from the upper surface of said horizontal rib parallel to each other, of which one nearer to said back wall being extended to said ceiling wall where there are provided two ribs extending perpendicular to the vertical rib nearer to said back wall to connect to the vertical rib.

* * * * *